United States Patent [19]

Desjardins et al.

[11] Patent Number: 4,532,669

[45] Date of Patent: Aug. 6, 1985

[54] CHIMNEY CLEANING APPARATUS

[76] Inventors: Wilfred J. Desjardins; Wayne W. Desjardins; Glen R. Desjardins, all of Main St., R.F.D. #1, Box 2, Van Buren, Me. 04785

[21] Appl. No.: 613,168

[22] Filed: May 23, 1984

[51] Int. Cl.[3] ..... F23J 3/00

[52] U.S. Cl. ..... 15/249; 15/163

[58] Field of Search ..... 15/162, 163, 242, 243, 15/249

[56] References Cited

U.S. PATENT DOCUMENTS

| | | | |
|---|---|---|---|
| 1,030,733 | 6/1912 | Johnston | 15/163 |
| 1,184,784 | 5/1916 | Steiner | 15/249 |
| 1,859,166 | 5/1932 | Premro | 15/249 |
| 4,340,989 | 7/1982 | Rotondi et al. | 15/163 |

FOREIGN PATENT DOCUMENTS 464295 3/1914 France .

*Primary Examiner*—Edward L. Roberts

*Attorney, Agent, or Firm*—Daniel H. Kane, Jr.

[57] ABSTRACT

A chimney cleaning system is permanently installed on a chimney for cleaning a flue of the chimney by either manual or automatic operation. The flue brush is seated in the chimney flue with cables also inside the flue secured to both ends of the brush for pulling the brush either upward or downward. A control box with a clutch mechanism for actuating or driving the cables in either direction by manual or automatic operation is installed outside the chimney at a convenient selected location on the side of the chimney. First and second lengths of cable secured to the top and bottom of the flue brush pass around pulleys mounted or anchored at the top and bottom of the chimney, then pass through guide sleeves and holes drilled in the side of the chimney to the control box. The control box is provided with a crank shaft and first and second reels mounted on the crank shaft for free wheeling on the shaft. A clutch mechanism upon actuation engages the shaft with either the first or second reel for rotation of either the first or second reel with the shaft while the other reel remains free wheeling. Thus, the reels can rotate in opposite directions on the same shaft reeling in one length of cable for pulling the brush in a desired direction while paying out the other length of cable on the slack side of the brush. The crank shaft can be rotated by either a manual crank or a motor such as an electric hand drill.

20 Claims, 11 Drawing Figures

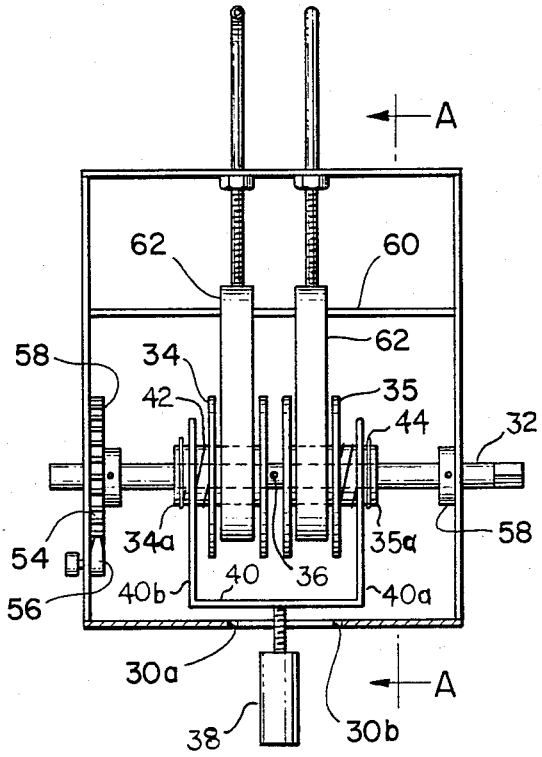
FIG. 2
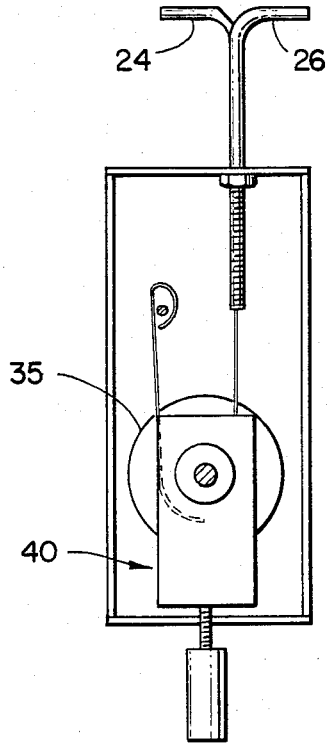
FIG. 2A
FIG. 2C
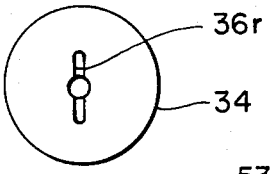
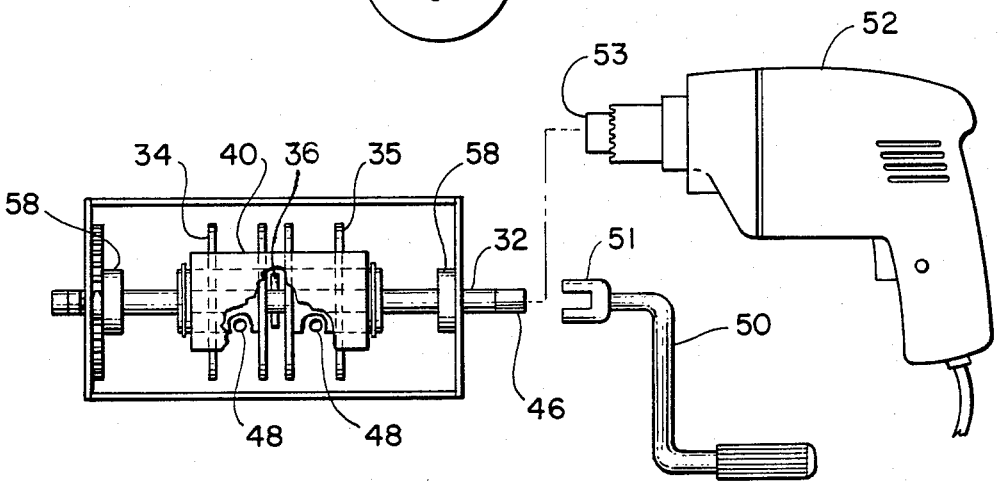
FIG. 2B

CHIMNEY CLEANING APPARATUS

TECHNICAL FIELD

This invention relates to a new chimney cleaning system and apparatus permanently installed on a chimney for cleaning a flue of the chimney by either manual or automatic operation.

BACKGROUND ART

A number of installed systems have been devised for periodically cleaning chimney flues to remove deposits of partially burned combustion products generally known as creosote and to minimize the risk of hazardous chimney fires. For example, the Johnston U.S. Pat. No. 1,030,733 and the Hermann French Pat. No. 464,295 describe installations in which a weighted brush remains seated in the chimney. For cleaning, the weighted brush is wound to the top of the chimney and then permitted to fall by gravity under its own weight. A disadvantage of this arrangement is, of course, that the weights may not be sufficient to pull the brush down the chimney in the event of irregularities or projections in the flue or buildup of deposits.

Chain actuated systems are described in the Steiner U.S. Pat. No. 1,184,784 and the Rotondi U.S. Pat. No. 4,340,989. A difficulty with these systems is that the chain becomes clogged with creosote buildup and slips out of the sprockets. The Messenger U.S. Pat. No. 606,567 describes a chimney cleaning system which is temporarily installed at a fireplace for cleaning the flue and which is then removed. Such a system must be replaced and removed during each cleaning and cannot be left as a permanent installation. The Premro chimney cleaning apparatus described in U.S. Pat. No. 1,859,166 is vulnerable because the mechanism of the apparatus remains in the flue where it may become clogged with creosote.

OBJECTS OF THE INVENTION

It is therefore an object of the present invention to provide a chimney cleaning system which may be permanently installed at the chimney and left in place.

Another object of the invention is to provide an installed chimney cleaning system capable of manual or automatic operation by excursion of a flue brush either up or down the flue of a chimney, even for irregular or crooked chimneys and even in the presence of projections or deposits.

A further object of the invention is to provide a permanently installed chimney cleaning system in which the major portion of the mechanisms of the apparatus are conveniently and compactly housed outside the chimney free from creosote deposits and clogging. In addition, portions of the apparatus installed in the flue of the chimney are designed to withstand and shed deposits of partial combustion products.

DISCLOSURE OF THE INVENTION

In order to accomplish these results, the invention provides a flue brush seated in the chimney flue with cables secured to the brush also mounted inside the flue for pulling the brush either upward or downward. A control box for actuating or driving the cables by manual or automatic operation is installed outside the chimney at a convenient selected location on the side of the chimney.

According to the invention, a first length of cable is secured to the top of the brush and a second length of cable is secured to the bottom of the brush. A first guide or pulley is mounted above the top of the chimney for reversing the direction of the first length of cable. The first length of cable therefore extends upward from the top of the brush through the flue to the top of the chimney, over the first guide or pulley and back down the flue. A second guide or pulley is mounted in the flue at the base of the chimney for reversing the direction of the second length of cable. The second length of cable extends from the bottom of the brush downward through the flue to the base of the chimney around the guide or pulley and back up the flue.

A control box is mounted on the outside of the chimney with a housing constructed and arranged for fitting over first and second drill holes to be formed through the side of the chimney at a convenient selected location. The drill holes extend between the control box and the inside of the flue. A first guide sleeve is mounted in the first drill hole extending upward into the flue for receiving and guiding the first length of cable extending back down the flue with reduced friction into the control box. A second guide sleeve is mounted in the second drill hole and extends downward into the flue for receiving and guiding the second length of cable passing back up the flue with reduced friction into the control box.

The invention provides a control box and housing having a crank shaft with at least first and second reels mounted on the crank shaft for free wheeling on the shaft. A clutch arrangement is constructed and arranged for engaging the shaft with either the first or second reel for rotation of either the first or second reel with the shaft while the other reel remains free wheeling.

According to the preferred embodiment, the clutch action is achieved by a shaft projection or shaft pin secured in fixed relationship to the shaft between the first and second reels. The reels are formed on the insides facing the shaft projection or pin with complementary recesses for receiving and engaging the shaft projection for rotation of either the first or second wheel with the shaft while the other reel remains free wheeling. The direction of excursion of the flue brush mounted in the chimney may be easily reversed, according to the preferred embodiment of the invention, by the clutch control lever. This may take the form, for example, of a U-bracket and lever arm for translation of the first and second reel and shaft relative to each other in the axial direction of the shaft for respectively engaging the clutch with either the first or second reel while the other reel remains free wheeling.

A feature and advantage of this control box and clutch arrangement is that the first and second reels can rotate in opposite directions on the same shaft, for example, reeling in the first length of cable on the first reel while paying out the second length of cable on the second reel.

The first length of cable extending back down the flue passes through the first guide sleeve with reduced friction into the control box and is secured at its end to the first reel. The first cable is formed with sufficient length stored on the first reel for unimpeded excursion of the flue brush throughout substantially the entire flue length of the chimney. The second length of cable passing back up the flue enters the control box with reduced friction through the second guide sleeve and is secured at its end to the second reel. The second cable is also formed with sufficient length stored on the second reel for unimpeded excursion of the flue brush throughout substantially the entire length of the chimney flue.

The invention contemplates both manual and automatic operation by providing either a manual crank at the end of the shaft or an electric drill for motorized operation. This is accomplished, for example, by forming a drill socket or drive at the end of the shaft for receiving the complementary fitting formed on the end of a manual crank or the chuck of an electric drill.

A feature and advantage of the system for cleaning chimney flues according to the invention is that the apparatus may be rapidly installed or retrofitted in existing chimneys with minimum physical intrusion upon the structure of the chimney. For example, the actual alteration of the chimney structure can be limited to the formation of two drill holes at a convenient selected location along the side of the chimney. The invention also contemplates a number of additional features and advantages, for example, for minimizing or avoiding the effects of the deposit of partial combustion products and for other purposes as will become apparent in the following specification and accompanying drawings.

BRIEF DESCRIPTION OF THE DRAWINGS

FIG. 2 is a diagrammatic plan view of the control box installed at the side of the chimney with the top of the control box housing removed.

FIG. 2A is a diagrammatic side view of the control box with the side of the control box housing cut away.

FIG. 2B is a diagrammatic front view of the control box with the front side of the control box housing removed and U-bracket partially cut away, and showing the alternative positioning of a hand crank or an electric drill at the complementary fitting formed at the end of the shaft.

FIG. 2C is a detailed fragmentary diagrammatic side view of the inner side of one of the reels showing the shaft pin recess for receiving and engaging the clutch mechanism shaft pin.

FIG. 4 is a diagrammatic plan view of the lower pulley and pulley holder shield installed in the flue at the base of the chimney and showing the bottom anchor, while

DESCRIPTION OF PREFERRED EXAMPLE EMBODIMENTS AND BEST MODE OF THE INVENTION

Figure 1:
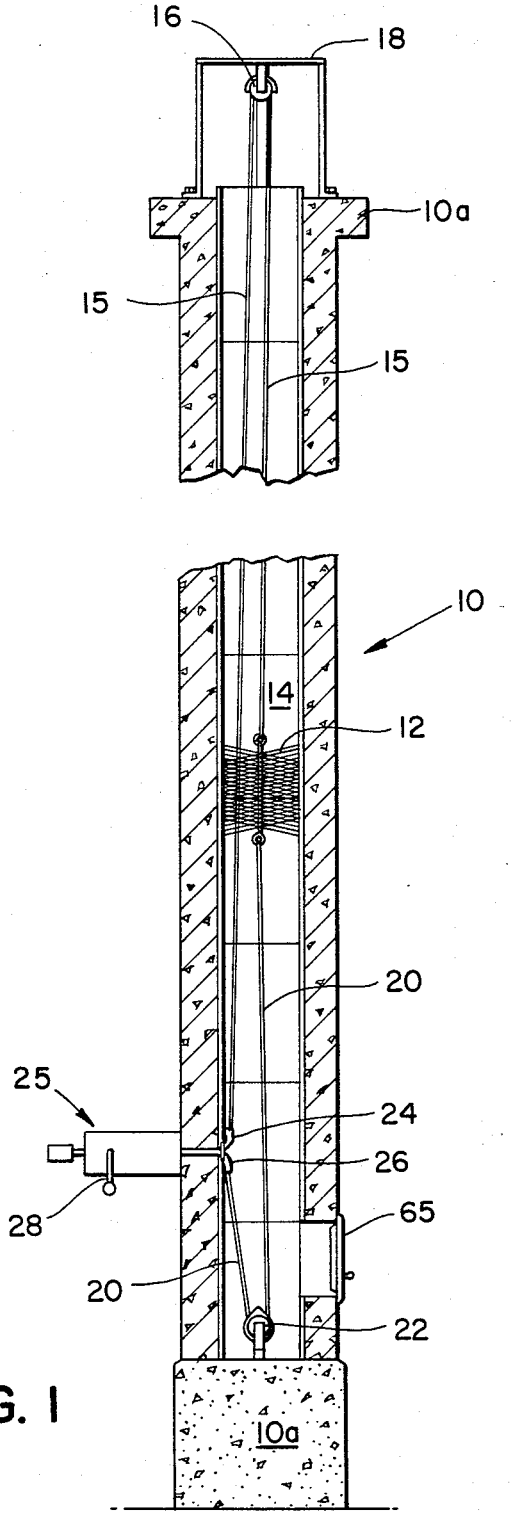
FIG. 1 is a diagrammatic side cross section view of a chimney showing an installed apparatus for cleaning a flue of the chimney according to the present invention.

A system for cleaning chimney flues according to the present invention is installed on the chimney 10 of FIG. 1. The installed chimney cleaning apparatus includes the chimney brush or flue brush 12 seated within the flue 14 of chimney 10. A first length of cable 15 is secured to the top of brush 12 and extends upward through the flue over the upper pulley 16 which reverses the direction of the first length of cable 15 so that it passes back down the flue. Pulley 16 is suspended from a simple framework or rack 18 having four legs anchored to the cap 10*a* of chimney 10 by four lead lags and lag screws. The rack 18 positions the pulley 16 over the top of chimney 10 a sufficient distance above the end of the flue 14 so that the chimney brush 12 partially emerges from the flue at the upper end of its excursion for cleaning the very top rim of the flue without entirely exiting. By always retaining a portion of the brush 12 within the flue 14, the brush is not free to rotate and tangle the cable.

A second length of cable 20 is secured to the bottom of flue brush 12 and extends downward through the flue 14 around the pulley 22 which reverses the direction of the cable 20 so that it passes back up the flue. The pulley 22 and pulley support are anchored into the concrete base 10*b* of chimney 10 by means of a lead lag and lag screw.

The first length of cable 15 extending back down the flue 14 from pulley 16 passes with reduced friction through a first cable guide or sleeve 24 to the control box 25. The second length of cable 20 extending back up the flue 14 from pulley 22 passes with reduced friction through the cable guide or sleeve 26 to control box 25. The cable guides or sleeves 24 and 26 are shown in greater detail and described hereafter with reference to FIG. 2A and FIG. 3. The control box 25 is shown with the manual crank 28 in position for manually winding or cranking the chimney brush 12 for excursion through substantially the entire length of flue 14 in either direction up or down. Whichever direction, up or down, the flue brush 12 is travelling, the hand crank 28 always turns in the same direction as hereafter described, in this instance the clockwise direction. The direction of traverse of the brush 12 is changed by the clutch mechanism, also hereafter described.

As shown in FIGS. 2, 2A, and 2B, the control box 25 is formed with a housing enclosure 30 through which passes the crank shaft 32 mounted for rotation within the housing 30. Spools or reels 34 and 35 are mounted on the crank shaft 32 for free wheeling or free rotation on the shaft. The first and second lengths of cable 15 and 20 respectively pass through the cable guide sleeves 24 and 26 shown in FIG. 2A. The first length of cable 15 is secured at its end to reel 34 while the second length of cable 20 is secured at its end to reel 35. In each case a sufficient length of cable is wound and stored on the reels 34 and 35 to permit the traverse or excursion of flue brush 12 throughout substantially the entire length of the flue 14 of chimney 10 as shown in FIG. 1. The respective lengths of cable 15 and cable 20 depends to some extent on the positioning of the control box 25 along the length of chimney 10. The length of the two cables 15 and 20 end to end is approximately three times the length of the chimney 10 plus an additional three to four feet (1 meter) added to each cable 15 and 20.

The spools or reels 34 and 35 are mounted for free wheeling rotation on the shaft 32 and include as integral portions of the reels, extending sleeves 34*a* and 35*a* respectively. For engaging the shaft 32 with either of the reels 34 or 35 a clutch mechanism is provided consisting of a shaft projection in the form of shaft pin 36 extending through shaft 32 and projecting from the shaft at a location between the reels 34 and 35 as shown in FIG. 2. At the midpoint position between reels 34 and 35 shown in FIG. 2, the shaft pin 36 engages neither of the reels. As shown in FIG. 2C, the inner side of each reel, for example reel 34, is formed with a complementary recess 36*r* adjacent to the center hole of the reel for receiving and engaging the shaft pin 36.

The complementary clutch elements of the clutch mechanism are actuated by a clutch lever or lever arm 38 connected to U-bracket 40 having two arms 40*a* and 40*b* coupled respectively to the integral extending sleeves 34*a* and 35*a* of the cable reels 34 and 35. Spool tension springs 42 are mounted on the reel extension sleeves 34*a* and 35*a* between each of the arms 40*a* and 40*b* of U-bracket 40 and the sides of reels 34 and 35 to provide tension on the sides of the spools. The U-bracket 40 is retained on the integral reel sleeves 34*a* and 35*a*, and the reels 34 and 35 are locked in position relative to U-bracket 40 so that they cannot approach each other on the shaft 32, by spring clips or lock clips 44 clipped onto the integral sleeves 34*a* and 35*a* outside the arms 40*a* and 40*b* of U-bracket 40.

In operation of the clutch mechanism, the clutch lever arm 38 is grasped and moved to the left or right thereby translating the U-bracket 40 and reels 34 and 35 as a unit relative to the shaft 32 along the axial direction of the shaft for engaging the shaft pin 36 in the shaft pin recess 36*r* of either reel 34 or reel 35. Appropriate notches 30*a* and 30*b* can be formed in the front side of housing 30 for lodging the lever arm 38 in either a left hand notch 30*a* in which position shaft pin 36 is received and engaged in the shaft recess 36*r* of reel 34, or a right hand notch 30*b* in which the shaft pin 36 is received and engaged in the shaft pin recess 36*r* of reel 35. A center neutral notch, not shown, can also be provided.

A feature and advantage of the clutch mechanism, according to the invention, is that while one of the reels 34 or 35 is engaged for rotation with shaft 32, the other reel remains free wheeling for free rotation on the shaft. By this expedient the two reels 34 and 35 may rotate in opposite directions for simultaneously winding in one length of cable, for example cable 15, while paying out or reeling out the other length of cable, for example cable 20. It is apparent that the clutch mechanism, according to the invention, may be implemented by a variety of configurations or shaft projections other than the shaft pin 36, with complementary engaging portions formed on the reels 34 and 35.

In operation of the control box 25 the shaft 32 may be rotated, for example, by either a manual crank 50 or a motor such as the electric hand drill 52 as shown in FIG. 2B. The end of shaft 32 is formed with a socket drive 46 for engaging the complementary socket or chuck 51 formed at the end of the manual crank 50 or the motor driven socket 53 formed on the end of the electric hand drill 52. In pulling the chimney brush 12 either up the chimney flue or down the chimney flue, the shaft 32 is always turned in the same direction. Reversal of direction of the traverse or excursion of the chimney brush 12 is achieved by actuating the clutch mechanism to engage the reel 34 and using cable 15 to pull the chimney brush up the chimney or by engaging reel 35 and using cable 20 to pull the chimney brush down the chimney. In either event, the shaft 32 continues to turn in the same direction and the reel which is not engaged remains free wheeling for paying out cable on the slack side of chimney brush 12.

In fact, according to the invention, the shaft 32 rotates, for example, only in the clockwise direction and is prevented from turning or rotating in the counterclockwise direction by a shaft lock in the form of a gear 54 which rotates with shaft 32 and a ratchet or lock mechanism 56 secured to the housing 30 and oriented to permit rotation only in the desired direction. Furthermore, the shaft is retained in the desired axial position relative to housing 30, and axial sliding of the shaft is prevented, by the shaft stop rings or spacers 58 shown in FIGS. 2 and 2B. Also visible in FIG. 2B are the holes 48 formed in the back of housing 30 through which pass the cables 15 and 20 from chimney flue 14 and cable sleeves 24 and 26 respectively into the control box 25.

Also shown in FIGS. 2 and 2A are the cable shields 62 which are secured at one end to the housing 30 by means of a rod 60 which passes through the housing. The cable shields 62 are formed of a resilient material such as a length of plastic biased at the free end against the lines of cable stored on the respective reels 34 and 35. The cable shields 62 keep the respective cables from becoming tangled on the reels. Because of the mounting of the shield 62 on the rod 60, the shields 62 are able to slide back and forth on rod 60 in an axial direction as a unit with the reels 34 and 35 upon actuation of the clutch mechanism by sliding the lever arm 38 and U-bracket 40 back and forth either right or left in the axial direction of shaft 32.

Figure 3:
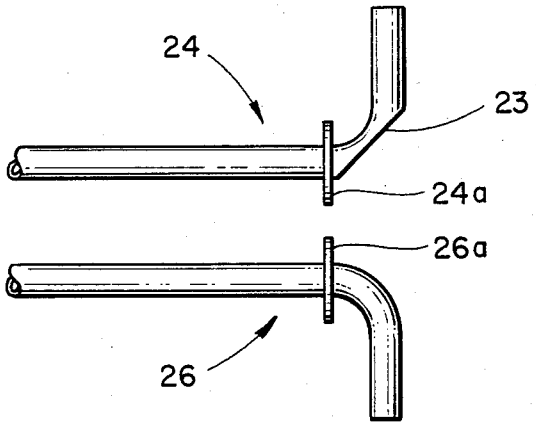
FIG. 3 is a detailed fragmentary diagrammatic side view of the cable guide sleeves which guide the first and second lengths of cable from the flue to the control box.

Referring in more detail to the components housed within the chimney 10, the cable guide sleeves 24 and 26 are 35 shown in greater detail in FIG. 3. The cable guide sleeve 26 is formed, for example, from ¼ inch (6.3 mm) pipe with a smoothly curved 90° bend to reduce friction on the cable. The guide sleeve 26 is installed in a hole drilled through the side of chimney 10 with the neck 26*a* of the guide sleeve abutting against the inner surface of flue 14. The 90° bend in guide sleeve 26 is appropriately directed downward for receiving and passing the lower length of cable 20 into the control box 25. The guide sleeve 24 is similarly constructed from ¼ inch (6.33 mm) pipe with a smooth 90° bend and a collar 24*a* which abuts against the inner wall of flue 14. The smooth 90° bend in guide sleeve 24 is appropriately directed upward for receiving and passing the upper cable 15 into the control box 25.

The upwardly directed bend in guide sleeve 24 tends to collect and channel liquid creosote which condenses on the cable 15. Such liquid creosote passing through the guide sleeve 24 therefore enters the control box 25. To prevent this from occurring, the present invention provides a creosote drip opening 23 formed on the lower side of the 90° bend by cutting away the lower portion of the pipe or sleeve as shown in FIG. 3. By this expedient, liquid creosote condensing on the cable 15 which tends to enter the pipe sleeve 24 is diverted from the control box 25 and passes out through the opening 23, dripping to the bottom of the chimney. While the two cable guide sleeves 24 and 26 are shown one above the other for clarity in FIG. 3, the guide sleeves are actually at the same horizontal level as shown in FIG. 1 and FIG. 2A and are instead spaced from each other horizontally, for example, as shown by the location of the cable entry holes 48 in FIG. 2B.

Figure 3A:
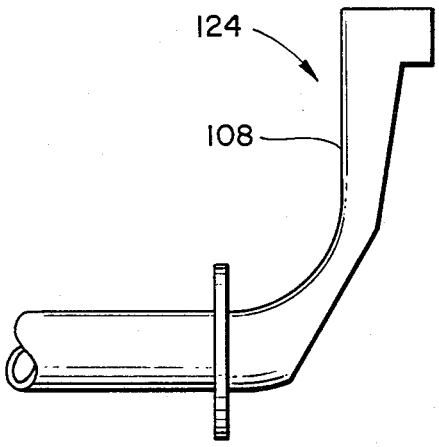
FIG. 3A is a fragmentary side view and FIG. 3B a front view of the upper guide sleeve with Teflon (trademark) lining.
Figure 3B:
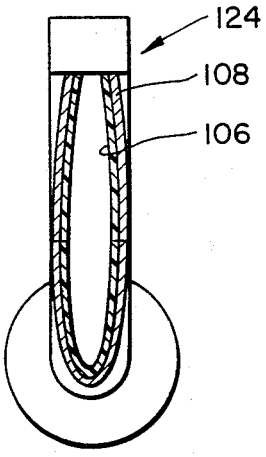

According to the preferred embodiment, the guide sleeves 24 and 26 are lined with tetra fluoroethylene (e.g. Teflon, trademark) tubing to reduce friction on the cables and to prevent creosote from adhering to the inside of the sleeves. For example, 4 inches (10 cm) of Teflon (trademark) tubing is inserted at the curved end of the sleeve and 1 inch (2.5 cm) is inserted at the straight end in a tight friction fit and bonded to the inside metal surface of the sleeve. The Teflon (trademark) lining withstands heating and cooling retaining its original characteristics over a long service life. In forming the upper guide sleeve, the inserted and bonded tetrafluoroethylene tubing lining 106 is also cut at the undersurface of the guide sleeve along with the pipe 108 as shown in the example guide sleeve 124 of FIGS. 3A and 3B. Of course, any nonstick or low friction durable plastic resin material can be used for the sleeve lining.

Installation of the cable guide sleeves 24 and 26 in the holes drilled through the side wall of chimney 20 does not require any modification of the chimney. If the location of control box 25 is selected at a position near the base of the chimney, the guide sleeves 24 and 26 may be inserted in the respective drill holes from access through the chimney clean out door 65. If it is not possible to reach the drilled holes in the sidewall of chimney 20 through the clean out door 65, then each of the guide sleeves is installed by first passing a cable through the corresponding drill hole from the outside until it reaches the bottom of the chimney and can be grasped through the clean out door 65. The cable is then threaded through or run through the L-shaped cable guide entering through the longer arm of the sleeve and exiting through the smooth 90° bend. A knot can then be tied around a flat washer to prevent the cable from sliding back through the sleeve. The cable is then retracted through the drilled hole from the outside of the chimney until the sleeve lodges in position in the drill hole. The cable is then pushed back down the chimney for removal of the knot and washer. Upon installation of the sleeve 24, a line can be dropped from the top of the chimney and tied to the cable at the clean out door 65 so that the cable can be pulled to the top of the chimney and threaded over pulley 16 and secured to the top of chimney brush 12. This cable thus becomes the upper or first cable length 15. After the guide sleeve 26 is installed and the cable pushed back down the chimney for removal of the knot and washer, the cable can be threaded around pulley 22 and tied to the bottom of chimney brush 12 through clean out door 65 so that this becomes the lower or second cable length 20.

A feature and advantage of the use of steel cable for the cable lengths 15 and 20 is that the cable can flexibly pass around the pulleys 16 and 22 without requiring sprockets and without clogging with creosote as occurs with the use of chains. It has been found that 1/16 inch (1.6 mm) high temperature stainless steel cable is suitable for this purpose.

Figure 4:
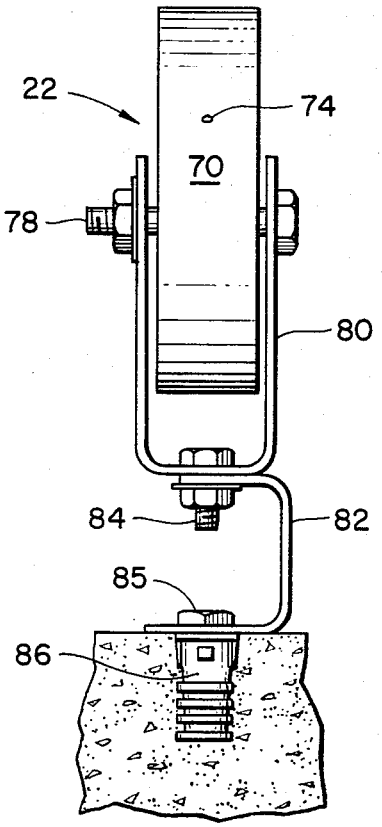
Figure 4A:
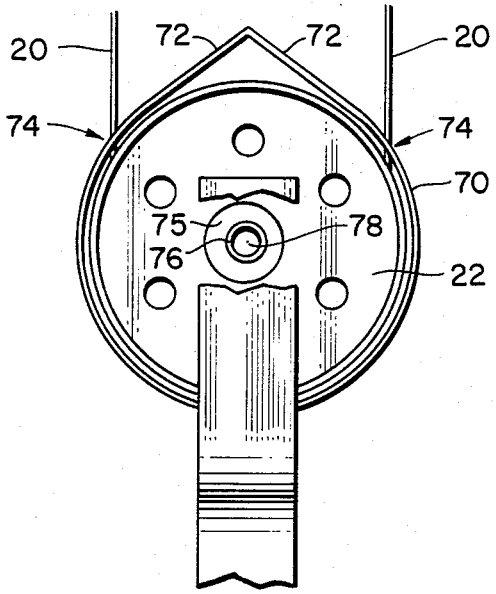
FIG. 4A is a diagrammatic side view of the pulley and pulley holder shield partially cut away.

The lower pulley 22 installed at the base of chimney 10 is shown in further detail in FIGS. 4 and 4A. The pulley 22 is mounted in a closely fitting annular enclosure 70 which prevents the cable from jumping off the pulley and sheds creosote away from the pulley mechanism. For this purpose the annular enclosure 70 is formed with inclined or pitched surfaces 72 over the top of the pulley. The close fitting enclosure 70 is formed with holes 74 on either side for passage of the cable 20 through the enclosure 70 and around the pulley 22.

The pulley 22 is provided with a double bearing for ensuring long service life in the demanding environment at the base of a flue. The pulley 22 is mounted on a first annular ball bearing sleeve 75 which is in turn mounted on a second brass sleeve insert bearing 76 in turn mounted on the bolt 78 which forms the rotational axis for pulley 22. The brass sleeve continues to function as a bearing with long service life, even if the ball bearing sleeve becomes clogged or frozen.

The bolt 78 mounts the pulley on a U-bracket 80 in turn secured to a second U-bracket 82 by bolt 84. It is the second U-bracket 82 which is anchored into the concrete base **10*b* of chimney 10 by means of a lag screw 85 secured in the lead lag anchor 86 which is anchored in the concrete base 10*b* of the chimney 10. Installation of the bottom anchor is accomplished through the clean out door 65 of chimney 10 by drilling a hole in the center of the base 10*b* of chimney 10 with a masonry drill bit. Alteration of the chimney structure is therefore not required. In the event a solid concrete base is not available at the bottom of the chimney, a new cement base can be poured. Alternatively, holes can be drilled through both sides of the chimney in the vicinity of the clean out door 65 and a threaded rod inserted entirely through the chimney for anchoring the pulley bracket. In that event, the anchor bolt 84** is inserted into a bracket which fits entirely around the threaded anchor rod.

Figure 5:
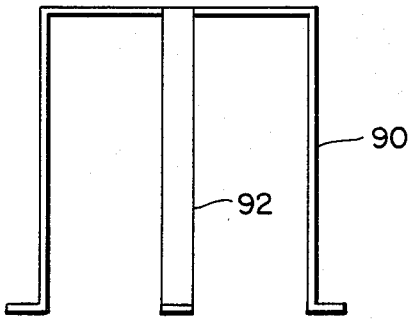
FIG. 5 is a side view of the frame, rack, or bracket installed on top of the cap of the chimney for supporting the upper cable pulley.

A pulley bracket and bearing arrangement similar to that described with reference to FIGS. 4 and 4A may be mounted at the top of the chimney suspended from the rack 18 shown in further detail in FIG. 5. The pulley rack 18 mounted at the top of the chimney may consist, for example, of a pair of U-brackets 90 and 92 crossing each other at right angles and secured to the masonry cap **10*a* of chimney 10 by lead lags and lag screws. The height of the rack 18 for upper pulley 16 is selected so that the chimney brush 12 will partially emerge from the top of flue 14 for cleaning the upper rim of the flue but without the brush entirely emerging from the flue. If the chimney brush merges entirely from the top of the flue it may turn or rotate and twist the supporting cable lengths. The pulley 16 is also constructed with an annular close fitting enclosure with holes for passage of cable length 15 through the enclosure and around the pulley 16**. For long and durable service life a double bearing arrangement is similarly used with the pulley mounted first on a ball bearing annulus in turn mounted on a brass sleeve insert bearing which will continue to provide a bearing surface and long bearing life around the pulley mounting bolt even if the ball bearing annulus becomes clogged with creosote.

While installing the pulley rack 18, a line can be passed down chimney 10 for retrieving the end of cable 15 at the clean out door 65, pulling it to the top of the chimney and passing it around the pulley 16 for securing to the top of chimney brush 12. This can be accomplished by weighting the cable and passing it back down the chimney for securing to the top of the brush at the clean out door 65. At this same location the lower cable 20 from sleeve 26 passing around the bottom pulley 22 can also be secured to the bottom of the brush. Appropriate measurements are made for the respective lengths of each cable to permit the brush to traverse the entire length of the chimney and an additional 3 to 4 feet (1 m) of excess leeway is added to each cable for storage on the reels. The brush is then pushed into the chimney flue keeping the cables free, all moving parts are lubricated, and the apparatus is ready for operation.

While the invention has been described with reference to particular example embodiments, it is intended to cover all variations and equivalents within the scope of the following claims.

We claim:

1. Apparatus installed in a chimney for cleaning a flue of the chimney by manual or automatic operation comprising:

a flue brush seated in the flue of the chimney;

a first flexible cable secured to the top of the brush;

a second flexible cable secured to the bottom of the brush;

first pulley means mounted above the top of the chimney for reversing the direction of the first cable, said first cable extending upward from the top of the brush through the flue to the top of the chimney, over the first pulley means and back down the flue;

second pulley means mounted in the flue at the base of the chimney, said second cable extending downward from the bottom of the brush through the flue to the base of the chimney, around the second pulley means and back up the flue;

a control box mounted on the outside of the chimney and constructed and arranged for fitting over first and second holes to be formed through the side of the chimney extending from said control box to the inside of the flue;

first guide means constructed and arranged to be mounted in the first hole extending into the flue for guiding the first cable passing back down the flue with reduced friction into the control box;

second guide means constructed and arranged to be mounted in the second hole extending into the flue for guiding the second cable passing back up the flue with reduced friction into the control box;

said control box comprising a crank shaft with at least first and second reels mounted on the crank shaft for free wheeling of the first and second reels on the shaft, clutch means constructed and arranged for engaging the shaft with either the first or second reel for rotation of either the first or second reel with the shaft while the other reel is free wheeling and clutch actuating means;

said first cable constructed and arranged for passing back down the flue through the first guide means to the first reel, said first cable secured at its end to the reel with sufficient length stored on the reel to permit the flue brush to pass through the flue from the base of the chimney to the top of the chimney;

said second cable constructed and arranged for passing back up the flue through the second guide means to the second reel, said second cable secured at its end to the second reel with sufficient length stored on the reel for passage of the chimney flue brush through the length of the flue from the base of the chimney to the top of the chimney;

and means for turning the control box crank shaft while actuating the clutch means to engage either the first or second reel for pulling the chimney flue brush either up the chimney or down the chimney, said first and second reels therefore turning in opposite directions on the crank shaft during cleaning of the chimney flue.

2. The apparatus of claim 1 wherein the means for turning the crank shaft comprises a manual crank formed on the end of the crank shaft outside the control box.

3. The apparatus of claim 2 wherein the manual crank is detachably mounted to the end of the crank shaft.

4. The apparatus of claim 1 wherein the means for turning the crank shaft comprises an electric drill socket drive formed on the end of the shaft for automated turning of the shaft using an electric grill.

5. The apparatus of claim 1 wherein the clutch means comprises a shaft projection in fixed relationship relative to the shaft between said first and second reels, said first and second reels formed with complementary recesses for receiving and engaging the shaft projection, and lever means for translation of the first and second reels and the shaft in the axial direction relative to each other for engaging the shaft projection respectively in either of the shaft projection recesses of the first and second reels whereby the shaft may engage either of the first or second reels for rotation with the shaft while the other reel is free wheeling.

6. The apparatus of claim 5 wherein the shaft projection comprises a shaft pin passing through the shaft in fixed relationship to the shaft between the first and second reels.

7. The apparatus of claim 1 further comprising a rack frame adapted to be mounted over the top of the chimney for supporting the first pulley means above the top of the chimney a sufficient distance so that the flue brush extends part way outside the top of the flue and chimney when the chimney brush is pulled to the top of the excursion through the flue.

8. The apparatus of claim 1 wherein the second pulley means is anchored to the bottom of the chimney and formed with an annular cover enclosure with sloping roof sections at the top for shedding creosote away from the pulley, said annular enclosure formed with holes for passage of the second cable down the flue around the pulley and back up the flue.

9. The apparatus of claim 1 wherein the first guide means comprises a curved sleeve extending into the first hole through the side of the chimney and extending upward into the flue for guiding and passing the first cable with reduced friction between the flue and the control box.

10. The apparatus of claim 9 wherein the curved sleeve of the first guide means is formed with an opening along the base of the curved portion of the sleeve for passing and shedding creosote to the bottom of the chimney which may pass into the top of the sleeve on the cable thereby preventing creosote from passing into the control box.

11. The apparatus of claim 9 wherein the guide means sleeve is lined at least at each end with a low friction plastic resin material.

12. The apparatus of claim 1 wherein the control box comprises first and second cable shields comprised of resilient material secured at one end to the control box housing, said first and second cable shields biased at their other ends respectively against the lengths of first and second cables stored respectively on the first and second reels to prevent tangling of the cables.

13. The apparatus of claim 1 wherein the first and second reels are formed respectively with outwardly extending sleeves and wherein the lever means comprises a U-bracket with first and second arms mounted respectively on the extending sleeves of the first and second reels for imparting relative axial motion between the reels and the shaft by shifting the U-bracket back and forth in an axial direction thereby translating the reels on the shaft in an axial direction toward and away from the shaft projection clutch means.

14. The apparatus of claim 13 further comprising first and second reel tension springs mounted on the respective extending sleeves of the first and second reels between the arms of the U-bracket lever means and the first and second reels.

15. Apparatus installed at a chimney for cleaning a flue of the chimney by manually or automatically actuated excursion of a flue brush substantially through the length of the flue comprising:

a flue brush to be seated in the flue of the chimney;

a first length of cable for passing through the flue to be secured at the top of the flue brush;

a second length of cable for passing through the flue to be secured at the bottom of the flue brush;

first guide means mounted above the top of the chimney for reversing the direction of the first length of cable, said first length of cable extending from the top of the flue brush upward through the flue to the top of the chimney, over the the first guide means and back down the flue;

second guide means mounted in the flue at the base of the chimney for reversing the direction of the second length of cable, said second length of cable extending from the bottom of the brush downward through the flue to the base of the chimney, around the second guide means and back up the flue;

control box means mounted on the outside of the chimney and comprising a housing constructed and arranged for fitting over first and second holes to be formed through the side of the chimney extending between said control box and the inside of the flue;

third guide means constructed and arranged to be mounted in the first hole and extending from the first hole upwardly into the flue for receiving and guiding the first length of cable passing back down the flue with reduced friction into the control box;

fourth guide means constructed and arranged to be mounted in the second hole and extending downward from the second hole into the flue for receiving and guiding the second length of cable passing back up the flue with reduced friction into the control box;

said control box comprising a crank shaft with at least first and second reels mounted on the crank shaft for free wheeling relative to the crank shaft, clutch means constructed and arranged for engaging the crank shaft with either the first or second reel and means for actuating said clutch means for rotation of either of the first and second reels with the shaft while the other reel remains free wheeling:

said first length of cable formed with sufficient length for passing back down the flue through the third guide means to the control box, said first length of cable secured at its end to the first reel and having sufficient length stored on the first reel for unimpeded excursion of the flue brush throughout substantially the entire length of the flue of the chimney;

said second length of cable formed with sufficient length for passing back up the flue through the fourth guide means into the control box, said second length of cable secured at its end to the second reel with sufficient length stored on the second reel for unimpeded excursion of the flue brush throughout substantially the entire length of the flue of the chimney;

and means for turning the control box crank shaft with the clutch means actuated for engaging either the first or second reel while the other reel remains free wheeling for cleaning the flue of the chimney by excursion of the flue brush throughout substantially the entire length of the flue of the chimney either up or down, said reels thereby rotating in opposite directions during rotation of th shaft and excursion of the flue brush through the flue of the chimney.

16. The apparatus of claim 15 wherein said clutch means comprises shaft projection means secured to the shaft in fixed relationship to the shaft between the first and second reels and wherein the first and second reels are formed on the side facing said shaft projection means with respective shaft projection recesses for receiving and engaging the shaft projection means, and wherein the means for actuating the clutch means comprises lever means for translating the first and second reels and shaft relative to each other along the axial direction of the shaft for engaging the shaft projection means with either the first or second reel while the other reel remains free wheeling.

17. The apparatus of claim 16 whereih the first and second reels are formed with respective outwardly projecting sleeves on said shaft and wherein the lever means for actuating the clutch means comprises a U-bracket formed with arms engaging the respective outwardly projecting sleeves of the first and second reels for translation of the first and second reels in an axial direction relative to the shaft by back and forth movement of the U-bracket in the axial direction of the shaft.

18. The apparatus of claim 17 wherein the control box comprises first and second cable shields secured at one end to the housing of the control box, said cable shields comprising resilient material biased at the free end against the lengths of cable stored on the respective first and second reels to prevent tangling of the cable, and further comprising reel tension springs mounted on the outwardly extending sleeves of the first and second reels between the respective first and second arms of the U-bracket and the respective first and second reels.

19. The apparatus of claim 16 wherein the control box further comprises shaft lock means secured between the shaft and control box housing constructed and arranged to permit the shaft to rotate in only one direction, said apparatus permitting excursion of the flue brush in either direction up or down the chimney by rotation of the shaft in only one direction according to whether the clutch means is actuated to engage either the first or seco d reel.

20. The app ratus of claim 19 wherein the shaft is formed at its end with socket drive means adapted to receive an electric drill for automated rotation of the shaft and cleaning of the flue of the chimney.

* * * * *